US005491897A

United States Patent [19]

Michelena

[11] Patent Number: 5,491,897

[45] Date of Patent: Feb. 20, 1996

[54] DISPOSABLE SPOON

[75] Inventor: Javier Michelena, San Sebastian, Spain

[73] Assignee: Comercial Mertapa, S.L., Spain

[21] Appl. No.: 280,494

[22] Filed: Jul. 26, 1994

[30] Foreign Application Priority Data

Sep. 9, 1993 [ES] Spain ..... 9302422

[51] Int. Cl.[6] ..... A47G 21/04

[52] U.S. Cl. ..... 30/328; 30/324; D7/653

[58] Field of Search ..... 30/324, 325, 326, 30/327, 328, 150, 149, 147; D7/664, 653

[56] References Cited

U.S. PATENT DOCUMENTS

| | | | |
|---|---|---|---|
| 1,521,768 | 1/1925 | Herrmann | 30/328 |
| 1,708,456 | 4/1929 | Tunick | 30/326 |
| 2,812,577 | 11/1957 | Leibow | 30/324 |
| 3,931,925 | 1/1976 | Ruff | 30/328 X |
| 4,060,176 | 11/1977 | Tobiasson | 30/328 X |
| 4,589,204 | 5/1986 | Vogel | 30/324 |
| 4,615,120 | 10/1986 | Newman | 30/324 |

FOREIGN PATENT DOCUMENTS

| | | | |
|---|---|---|---|
| 0400708 | 12/1990 | European Pat. Off. . | |
| 10998 | of 1898 | United Kingdom | 30/326 |

*Primary Examiner*—Rinaldi I. Rada
*Attorney, Agent, or Firm*—Lucas & Just

[57] ABSTRACT

A disposable spoon is disclosed which consists of an annular element of a firm nature, such as cardboard. The annular element is extended longitudinally by means of a flexible joint into a laminar body of a deformable nature, such as glazed paper. The laminar body has a shape similar to that of the annular element on to which it will be folded. There is further provided a handle with a groove for attaching it to the superimposed assembly of the annular element and the laminar element.

1 Claim, 2 Drawing Sheets

DISPOSABLE SPOON

OBJECT OF THE INVENTION

The present invention relates to a spoon which is intended to be of a disposable nature and which has been designed and constructed in order to achieve, together with a highly simple and therefore economical construction, a folding or detachable nature which enables the said spoon to occupy the minimum of space, making it easy to combine with the pack for the consumption of which the spoon is to be used.

BACKGROUND TO THE INVENTION

A variety of soft foodstuffs exists which have to be consumed with the aid of a spoon and which are marketed in hermetically sealed packs, such as for example yoghurts, custards, créme caramels etc.

For commercial reasons, among others, it is desirable for this type of pack to be provided with a disposable spoon to facilitate the consumption of its contents without the said spoon having a significant effect on the cost level, and on the other hand the spoon must be incorporated into the pack in some way in order to facilitate the handling of the same during the process of marketing the product. A simple plastic teaspoon may be suitable in principle for the intended purpose but either its dimensions are very small, which means that eating is difficult, or if the dimensions are normal the spoon is too large compared with the pack and this causes packaging and handling problems.

DESCRIPTION OF THE INVENTION

The disposable spoon proposed by the invention has been designed in order to provide a completely satisfactory solution to this problem, such that when not in use it occupies the minimum of space so that it fits easily on the pack with which it is to be used for the consumption of the contents thereof, but it also offers optimum features in terms of operating capacity during the consumption phase of the said product.

In one practical embodiment the proposed spoon is made up of a functional combination of three parts, a ring, preferably oval, with a short appendage extending its main axis, this ring being made from a semi-rigid material such as for example cardboard, plastic or similar, a deformable laminar element based on glazed paper, plastic or similar in which two oval sectors are defined, one annular and the other completely closed, which can be folded one on top of the other with interposition of the intermediate rigid ring and provided on their free ends with appendages or elongations similar to those on the rigid ring, but one longer than the other, this assembly being completed by a handle or grip, also flat, grooved at one end in order to be joined to the appendage of the rigid ring, with interposition of the appendages of the laminar element covering it.

In accordance with this construction the rigid ring and its laminar wrapping may be initially fixed, constituting an assembly which is physically independent of the handle or grip, the reduced volume of which will enable it to fit for example in the indentation in the pack lid, whilst when the spoon is to be used it is sufficient to deform the closed sector of the deformable laminar element with a light pressure in order to form the cavity corresponding to the actual spoon and to attach the same to the complementary handle or grip so that the spoon is ready for use and has an adequate capacity.

DESCRIPTION OF THE DRAWINGS

In order to complement the present description and with the aim of facilitating understanding of the characteristics of the invention, the present specification is accompanied, as an integral part thereof, by a set of drawings in which, by way of an illustration but not constituting a limitation, the following has been depicted.

PREFERRED EMBODIMENT OF THE INVENTION

An examination of these figures will show how the proposed spoon is constructed from the ring (1) of rigid or semi-rigid material, such as for example plastic or cardboard, the periphery of which is adapted in terms of its shape and dimensions to those of a spoon and which consequently adopts the classic oval configuration, having a small appendage (2) as an elongation of its main axis, i.e. corresponding to the area intended for affixing the handle or grip (3) which constitutes a physically independent part, flat, relatively short, with a groove (4) at one end, having a widened entrance for joining it to the appendage (2) of the ring (1), this handle or grip (3) obviously also being rigid or semi-rigid in nature, based on plastic, cardboard or similar.

Figure 1:
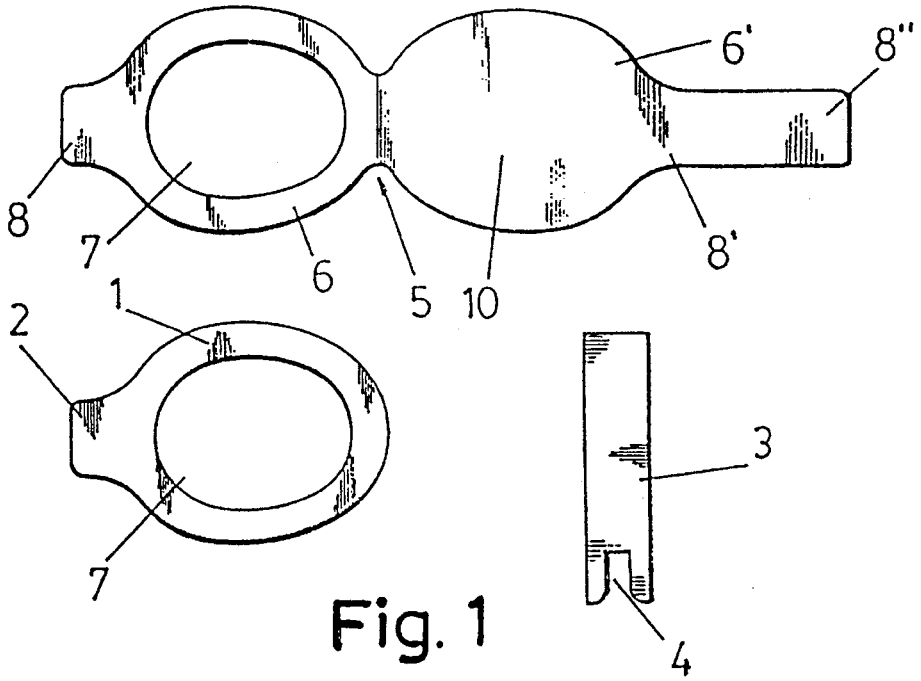
FIG. 1—This show a disassembled version of a disposable spoon made in accordance with the object of the present invention, the three basic parts of which are shown extended and in a plan view.
Figure 2:
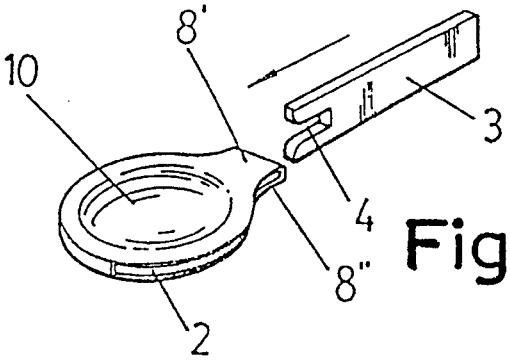
FIG. 2—This shows a perspective view of the assembly from the above figure, in which the laminar element is shown appropriately fitted on to the rigid ring, and the complementary handle or grip is shown in a position facing this assembly.

The ring (1) is complemented by a deformable laminar element (5) which may be made of very thin plastic, special glazed paper or other suitable material, and in which two sectors (6–6') are defined with an oval outline coinciding with that of the ring (1), sector (6) being annular, i.e. having an orifice (7) the shape and dimensions of which coincide with the orifice of the ring (1), whilst sector (6') is completely closed, each of these sectors having appendages (8–8') similar to the appendage (2) of the ring (1) except that one of them, reference (8'), is considerably elongated in a wide sector (8"), all of this being such that the annular sector (6) can be fitted and fixed on the lower face of the ring (1), the sector (6') can be fitted on its upper face and the elongation (8") can be folded beyond the sector (8") towards the lower face of the appendage (2) of the ring, with the interposition of the elongation or appendage (8) of the annular sector (6), as may be seen particularly in the section of FIG. 2, whereby the said laminar element can maintain this position stably by means of an adhesive fixing it to the ring (1) or by any other means considered appropriate.

Figure 3:
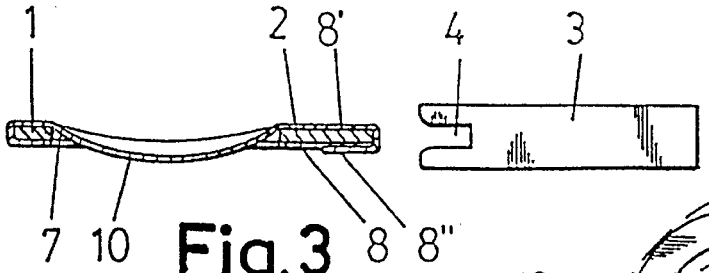
FIG. 3—This shows a detail of the longitudinal section of the assembly depicted in the above figure.
Figure 4:
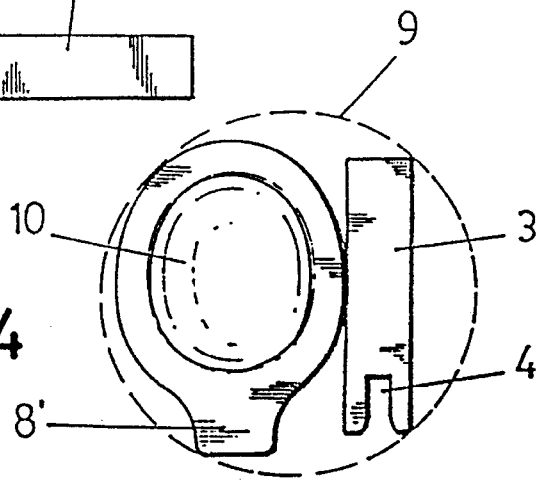
FIG. 4—This shows, finally, a practical example of the positioning of the spoon, disassembled, on the lid of a pack in which the said spoon has been provided as a means of facilitating the consumption of its contents.
Figure 6:
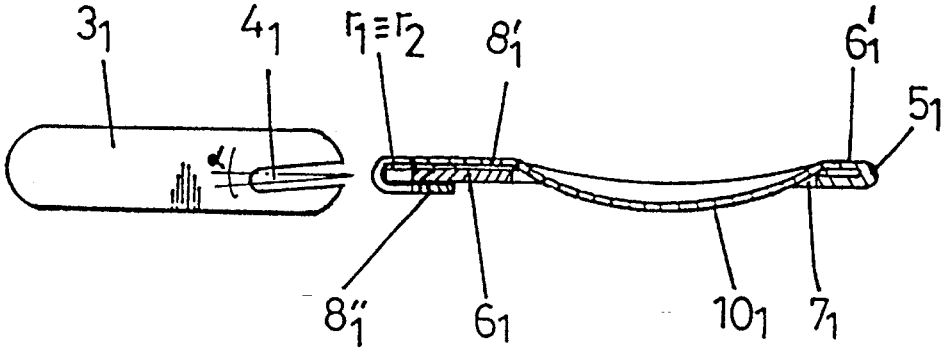
FIG. 6 is a representation of the elements of FIG. 5, folded and ready to use.

In any case a spoon is obtained in which the actual spoon is detachable from the complementary handle (3), where the said actual spoon is initially flat which enables it to fit for example in the cavity or indentation usually found in the lid (9) of the type of packs for which the spoon in question is intended, to facilitate the subsequent consumption of its contents as can be seen in FIG. 4, and which at the time of use is converted to a true spoon by means of a simple deformation of the central sector (10) of its closed sector (6'), as can be seen in the section of FIG. 3, and by means of attaching the said actual spoon to the complementary handle (3).

Figure 5:
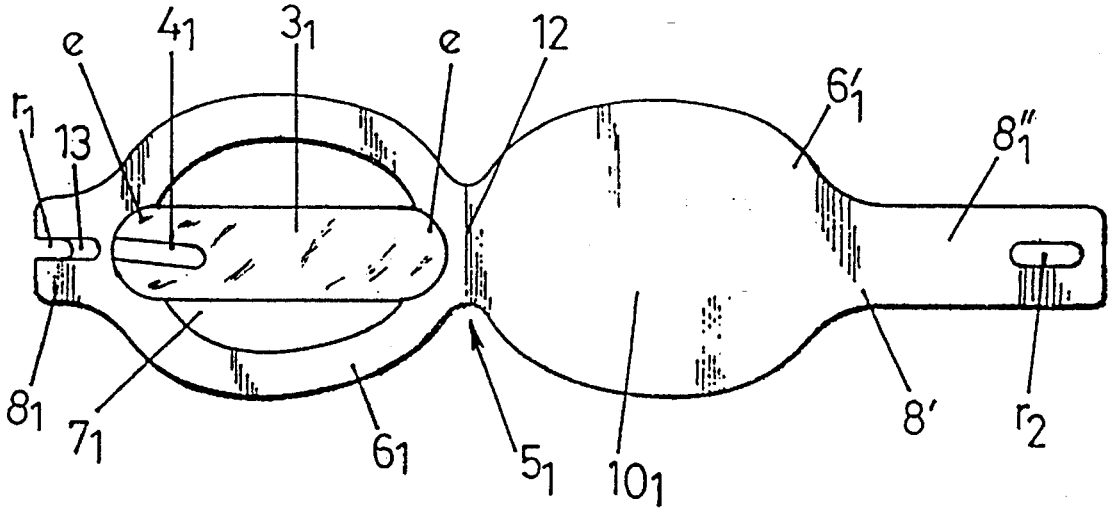
FIG. 5 is a plan representation of another practical embodiment of the invention with the elements unfolded.

In the embodiment of FIG. 5 the ring (1) disappears as an independent part and the option of stiffening the annular sector ($\mathbf{6_1}$) of the element ($\mathbf{5_1}$) is taken.

Specifically, the first sector (annular sector) ($\mathbf{6_1}$) is firm in nature (rigid or semi-rigid) and the second sector (laminar element) ($\mathbf{6_1}$') is flexible in nature, or even permanently deformable.

Both sectors ($\mathbf{6_1}$) ($\mathbf{6_1}$') will form a single element ($\mathbf{5_1}$) right from the start, for example, being manufactured from one and the same sheet of plastic material with a die with two zones at different temperatures or because the manufacturer has joined the two sectors ($\mathbf{6_1}$) ($\mathbf{6_1}$') at the narrow zone (12) by any method, for example adhesion.

In order for the disposable spoon to be usable, it would suffice for the laminar element ($\mathbf{6_1}$') to be folded on to the annular sector ($\mathbf{6_1}$) and for the annular sector ($\mathbf{6_1}$) to be provided with the elongation ($\mathbf{8_1}$) of sufficient size to act as a handle, possessing simple means of connection between the two elongations ($\mathbf{8_1}$) ($\mathbf{8_1}$").

The applicant, wishing to have a better finished product, has arranged that at the same time as the perforation ($\mathbf{7_1}$) is formed, part of the surplus material is utilised to manufacture the handle ($\mathbf{3_1}$), the ends (e) of which preferably penetrate the body of the first sector ($\mathbf{6_1}$) in order to maintain the handle "in situ".

The handle ($\mathbf{3_1}$) will consist of a groove ($\mathbf{4_1}$) positioned to connect it to the groove ($r_1$) of the outer end of the first sector ($\mathbf{6_1}$) and groove ($r_1$) of the elongated part ($\mathbf{8_1}$") (outer end) of the second sector ($\mathbf{6_1}$'), once the second sector ($\mathbf{6_1}$') has been folded down on to the first sector ($\mathbf{6_1}$) and the elongated part ($\mathbf{8_1}$") has been folded towards the lower face of the first sector ($\mathbf{6_1}$)

(FIG. 2 ).

The central part ($\mathbf{10_1}$) of the second sector (6') is deformed and the spoon is ready to use.

The spoon may be incorporated directly into the pack, externally or internally; it may be placed in a small bag or case which will separate it from the product to be consumed or from external influences or it may be placed in the pack by any conventional means.

The groove ($r_1$) of the elongation ($\mathbf{8_1}$) may be extended by a recess (13) which serves as a guide for the handle ($\mathbf{3_1}$) and the groove ($\mathbf{4_1}$) of the handle ($\mathbf{3_1}$) may be at an angle ($\alpha$) with respect to its longitudinal axis in order to facilitate fitting and use.

It is not considered necessary to expand this description further in order for any person skilled in the art to understand the scope of the invention and the advantages derived therefrom.

The materials, shape, size and arrangement of the elements will be subject to variation in so far as this does not involve any change to the essential features of the invention.

The terms in which this specification has been drawn up shall always be taken in the broad sense and shall not be taken as limiting the invention.

I claim:

1. A disposable spoon comprising:

a) a stiff annular element;

b) a deformable laminar element folded over the entire annular element;

c) said deformable laminar element being deformed in its central region to form a closed spoon surface;

d) elongations formed at the annular element and laminar element fold; and e) a handle with a groove which engages said elongations.

* * * * *